US007458782B1

(12) United States Patent
Spadola, Jr. et al.

(10) Patent No.: US 7,458,782 B1
(45) Date of Patent: Dec. 2, 2008

(54) COMPUTER MONITORING SYSTEM FOR PUMPS

(76) Inventors: Joseph Spadola, Jr., 354 Shaler Blvd., Ridgefield, NJ (US) 07657; Joseph R. Damianoe, 28 Robinson Ave., Glen Rock, NJ (US) 07452; Anthony Peluso, 825 Englemere Blvd., Toms River, NJ (US) 08757

( * ) Notice: Subject to any disclaimer, the term of this patent is extended or adjusted under 35 U.S.C. 154(b) by 864 days.

(21) Appl. No.: 10/817,276

(22) Filed: Apr. 2, 2004

Related U.S. Application Data

(63) Continuation-in-part of application No. 10/764,392, filed on Jan. 23, 2004.

(51) Int. Cl.
*F04B 49/00* (2006.01)

(52) U.S. Cl. ..... 417/36; 417/14

(58) Field of Classification Search ..... 417/18, 417/36, 53, 63, 14, 44.1, 278
See application file for complete search history.

(56) References Cited

U.S. PATENT DOCUMENTS 4,222,711 A 9/1980 Mayer
4,296,633 A * 10/1981 Hakansson et al. ..... 374/185
4,808,077 A * 2/1989 Kan et al. ..... 417/2
5,314,313 A 5/1994 Janesky
5,672,050 A * 9/1997 Webber et al. ..... 417/18
6,232,883 B1 5/2001 Silva et al.
6,364,620 B1 4/2002 Fletcher et al.
6,499,961 B1 * 12/2002 Wyatt et al. ..... 417/36
2003/0049134 A1 * 3/2003 Leighton et al. ..... 417/40

* cited by examiner

*Primary Examiner*—Devon Kramer
*Assistant Examiner*—Vikansha Dwivedi
(74) *Attorney, Agent, or Firm*—Michael A. Blake

(57) ABSTRACT

A computer monitoring system for controlling the operation of a sump pump, and reporting failure of the sump pump. The computer monitoring system includes a sump pump designed for pumping water out of a sump pit, a level sensing assembly positioned within the sump pit for detecting a level of water in the sump pit, and a control interface program operationally interacting with the conventional information handling system and operationally coupled to the sump pump and the level sensing assembly through the conventional information handling system for activating the sump pump when the level sensing assembly signals that water in the sump pit has reached a predetermined level.

43 Claims, 5 Drawing Sheets

COMPUTER MONITORING SYSTEM FOR PUMPS

CROSS REFERENCE TO RELATED APPLICATION

This application is a continuation-in-part of application Ser. No. 10/764,392, filed Jan. 23, 2004.

As a continuation-in-part, this application does repeat a substantial portion or all of the earlier non-provisional application(s) referenced above. However, because this continuation-in-part application also adds matter not disclosed in the earlier non-provisional application(s), some descriptions, definitions, and usages may be incorporated, which are either inappropriate or not applicable to the prior above referenced application(s). Further, some aspects of the present invention may be contradictory with some aspects of the prior invention disclosed in the earlier non-provisional application(s).

BACKGROUND OF THE INVENTION

1. Field of the Invention

The present invention relates to sump pumps and pump controls and more particularly pertains to a new pump control and management system for monitoring and controlling sump pumps as well as providing supplemental controls and alarms.

2. Description of the Prior Art

The use of sump pumps and pump controls is known in the prior art. Examples include U.S. Pat. No. 6,364,620; U.S. Pat. No. 6,232,883; U.S. Pat. No. 5,314,313; U.S. Pat. No. 3,872,419; and U.S. Pat. No. 4,222,711.

While these devices fulfill their respective, particular objectives and requirements, the need remains for a system that provides periodic maintenance, pump monitoring, and auxiliary pumping capabilities.

SUMMARY OF THE INVENTION

The present invention meets the needs presented above by providing a means for interfacing a conventional information handling system (personal computer) with a sump pump and a user reporting system for alerting a user to problems with the system.

One advantage to the present system is the ability to "call out" over a communications system to alert someone at a remote location to a problem, even before damage may have occurred. An example of such a communications system, by way of illustration and not limitation is a conventional telephone system.

Another advantage of the present invention is the capability for auxiliary monitoring of other water or fluid related items such as water heaters, sinks, washing machines, and pools.

Yet another advantage of the present invention is the capability to use power line modulation to route signals between the sump pump, various sensors, and a conventional computer supplied by the user without the need for dedicated wiring for enhanced installation capabilities.

At least one embodiment of the present invention is designed to work with a conventional information handling system, such as a personal computer. The state of the art of information handling systems changes at a very rapid rate. FIG. 2 shows an illustrative example of a block diagram of a typical information handling system 100 in accordance with the present invention. In this embodiment, processor 102, system controller 112, cache 114, and data-path chip 118 are each coupled to host bus 110. Processor 102 is a microprocessor such as a 486-type chip, a Pentium, Pentium II, Pentium III, or the like suitable microprocessor. Cache 114 provides high-speed local-memory data (in one embodiment, for example, 512 KB of data) for processor 102, and is controlled by system controller 112, which loads cache 114 with data that is expected to be used soon after the data is placed in cache 112 (i.e. in the near future). Main memory 116 is coupled between system controller 112 and data-path chip 118, and in one embodiment, provides random-access memory between 16 MB and 128 MB of data.

In one embodiment, main memory 116 is provided on SIMMs (Single In-line Memory Modules), while in another embodiment, main memory 116 is provided on DIMMs (Dual In-line Memory Modules), each of which plugs into suitable sockets provided on the motherboard holding these components and many of the other components shown in FIG. 1. main memory 116 includes standard DRAM (Dynamic Random-Access Memory), EDO (Extended Data Out) DRAM, SDRAM (Synchronous DRAM), or the like suitable memory technology. System controller 112 controls PCI (Peripheral Component Interconnect) bus 120, a local bus for system 100 that provides a high-speed data path between processor 102 and various peripheral devices, such as video, disk, network, etc. Data-path chip 118 is also controlled by system controller 112 to assist in routing data between main memory 116, host bus 110, and PCI bus 120.

In one embodiment, PCI bus 120 provides a 32-bit-wide data path that runs at 33 MHz. In another embodiment, PCI bus 120 provides a 64-bit-wide data path that runs at 33 MHz. In yet other embodiments, PCI bus 120 provides 32-bit-wide or 64-bit-wide data paths that run at higher speeds. In one embodiment, PCI bus 120 provides connectivity to I/O bridge 122, graphics controller 127, and one or more PCI connectors 121, each of which accepts a standard PCI card (not shown). In one embodiment, I/O bridge 122 and graphics controller 127 are each integrated on the motherboard along with system controller 112, in order to avoid a board-to-connector-to-board signal crossing interface, thereby providing better speed and reliability. In the embodiment shown, graphics controller 127 is coupled to a video memory 128 that includes memory such as DRAM, EDO, DRAM, SDRAM, or VRAM (Video Random-Access Memory), and drives VGA (Video Graphics Adapter) port 129 can connect to VGA-Type or SVGA (Super VGA)-type displays or the like. Other input/output (I/O) cards having a PCI interface can be plugged into PCI connectors 121.

In one embodiment, I/O bridge 122 is a chip that provides connection and control to one or more independent IDE connectors 124, to one or more SCSI connectors 125, to one or more USB (Universal Serial Bus) ports 126, and to an ISA (Industry Standard Architecture) bus 130. In this embodiment, IDE connector 124 provides connectivity for up to two or more standard IDE-type devices, in particular those for non-volatile memory storage and/or retrieval such as hard disk drives, CD-ROM (Compact Disk-Read-Only Memory) drives, DVD (Digital Video Disk or Digital Versatile Disk) drives, or TBU (Tape-Backup Unit) devices. As will be appreciated by those skilled in the art, client systems in a network, such as web pads, need not be equipped with any such non-volatile memory storage devices, relying instead upon the function of such devices in a server to which the client is connected.

In one similar embodiment, two IDE connectors 124 are provided, each providing an EIDE (Enhanced IDE) compliant architecture. In the embodiment shown, Small Computer System Interface (SCSI) connector 125 provides connectivity for preferably up to seven or fifteen SCSI-type devices depending on the version of SCSI supported by the respective embodiment. In one embodiment, I/O bridge 122 provides ISA bus 130 having one or more ISA connectors 131 (in one embodiment, three connectors are provided). In one embodiment, ISA bus 130 is coupled to I/O controller 152, which in turn provides connections to two serial ports 154 and 155, parallel port 156, and FDD (Floppy-Disk Drive) connector 157. In one embodiment, FDD connector 157 is connected to FDD 158 that receives removable media (floppy diskette) 159 on which data and/or program code 160 is stored.

In one such embodiment, program code 160 includes code that controls programmable system 100 to perform an application program as described in accordance with the invention. In an embodiment typical for client systems, and characteristics of "thin clients" such as web pads, serial port 154 is connectable to a computer network such as a local network or the Internet, and such network has program code 160 that controls programmable system 100 to act as a client, receiving and interpreting data sent by a matching server computer application. In another such embodiment characteristic of server systems, serial port 154 is connectable to a computer network such as a local network or the Internet, and special program code 160 within programmable system 100 executes that causes programmable system 100 to act as a server, providing data and applications over the network to a matching client computer program that is capable of properly interpreting that data and applications.

In one embodiment, ISA bus 130 is connected to buffer 132, which is connected to X bus 140, which provides connections to real-time clock 142, keyboard/mouse controller 144 and keyboard BIOS ROM (Basic Input/Output System Read-Only Memory) 145, and to system BIOS ROM 146. FIG. 2 shows one exemplary embodiment of the information handling system contemplated by the present invention, however other bus structures and memory arrangements are specifically contemplated. It should be appreciated that modification or reconfiguration of information handling system 100 of FIG. 2 by one having ordinary skill in the art would not depart from the scope or the spirit of the present invention.

In addition to utilizing a conventional information handling system as discussed above, the present invention generally comprises a level sensing assembly positioned within the sump pit for detecting a level of water in the sump pit, and a control interface program operationally interacting with the conventional information handling system and operationally coupled to the sump pump and the level sensing assembly through the conventional information handling system for activating the sump pump when the level sensing assembly signals that water in the sump pit has reached a predetermined level.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
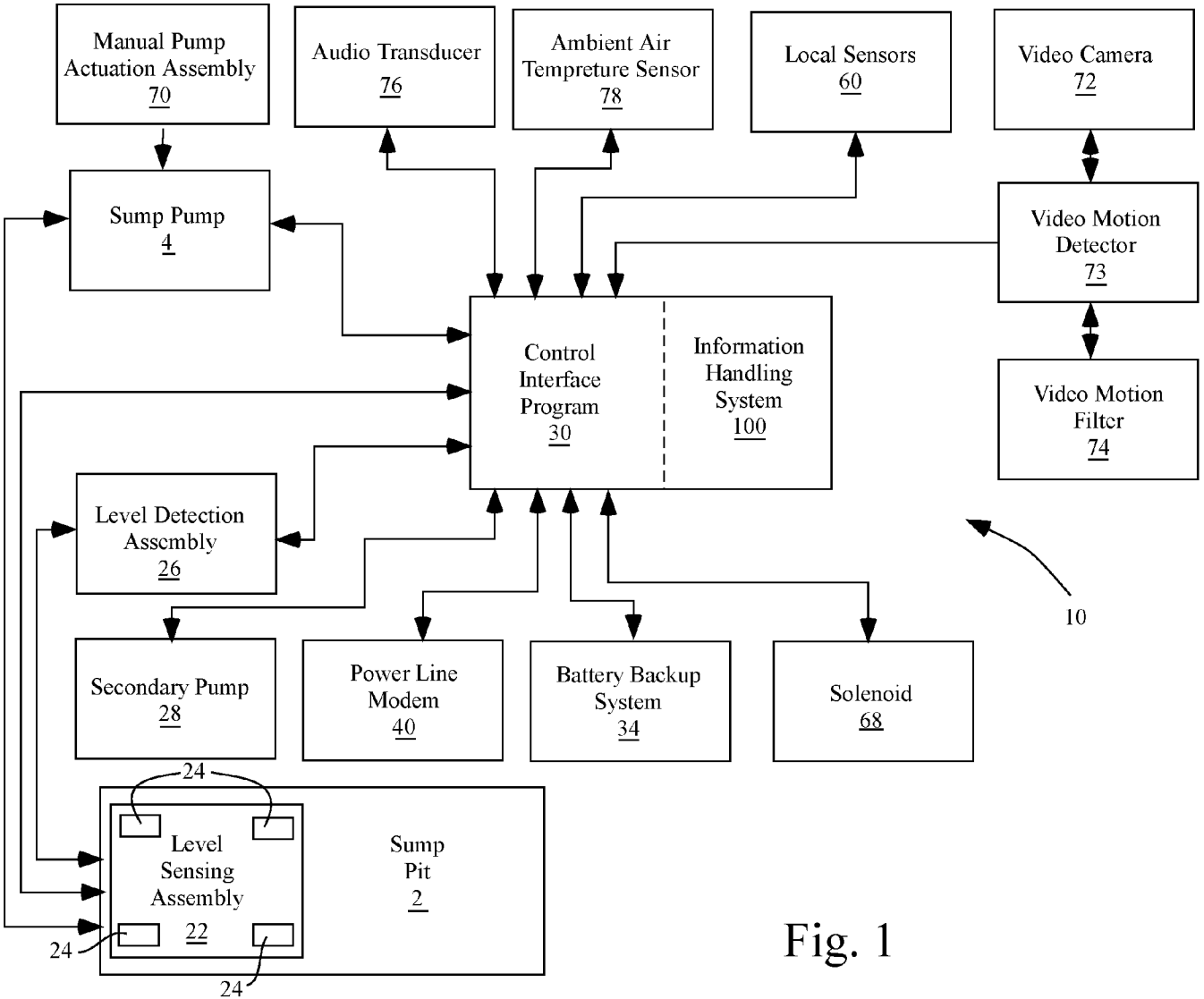
FIG. 1 is a schematic block diagram of a new computer monitoring system for pumps according to the present invention.
Figure 2:
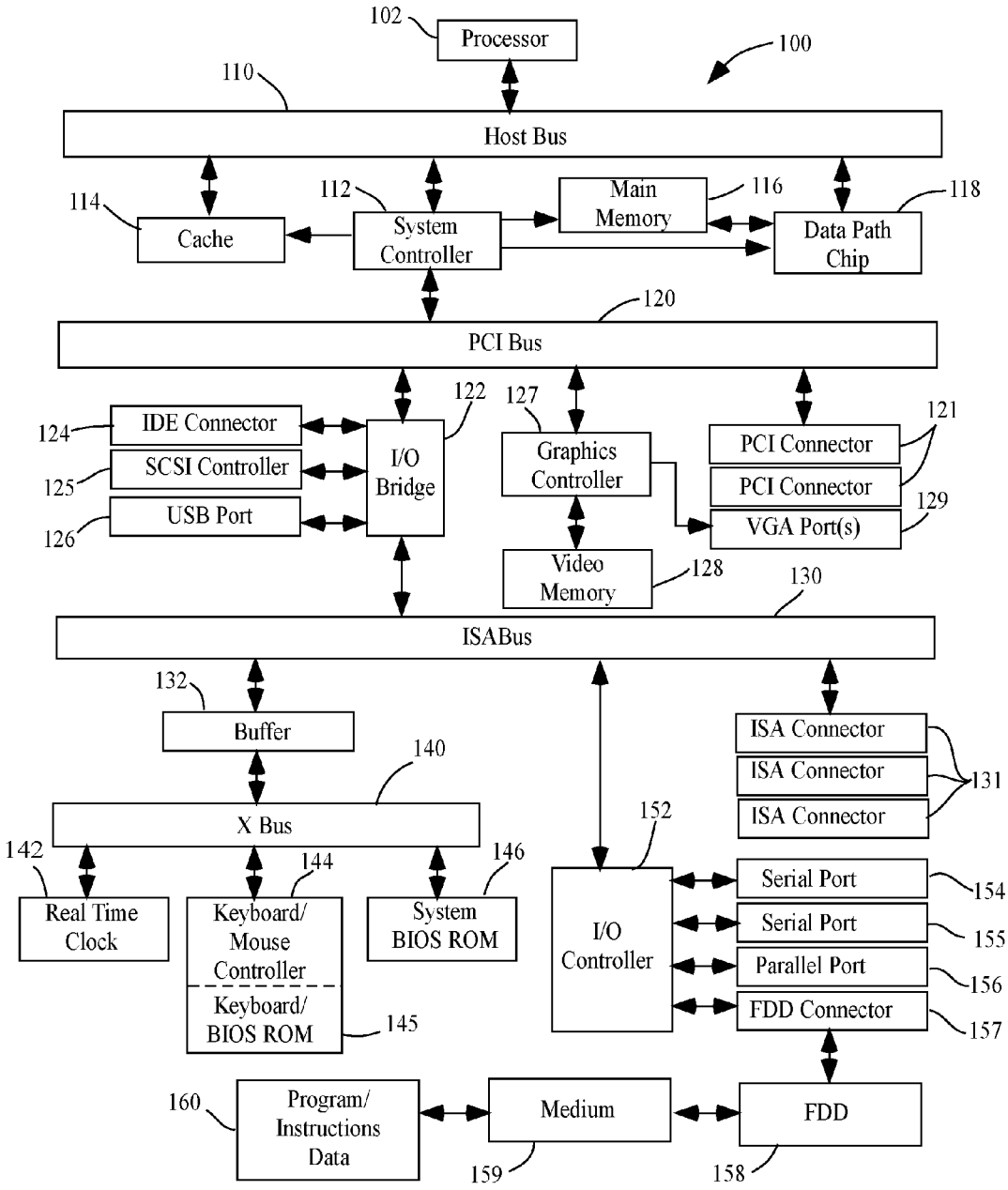
FIG. 2 is a schematic diagram of a conventional information handling system used in conjunction with the present invention.

In the following detailed description of preferred embodiment and other embodiments according the to present invention, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

With reference now to the drawings, and in particular to FIGS. 1 through 5 thereof, a new pump control and management system embodying the principles and concepts of the present invention and generally designated by the reference numeral 10 will be described.

As best illustrated in FIGS. 1 through 5, the pump control and management system 10 generally comprises a level sensing assembly 22, a control interface program 30, and at least one local sensor 60.

A conventional sump pump 4 is designed for pumping water out of a sump pit 2. The level sensing assembly 22 is preferably positioned within the sump pit 2 for detecting a level of water in the sump pit 2. The level sensing assembly 22 and the control interface program 30 interact with the sump pump 4 to facilitate pumping water out of the sump pit 2.

The control interface program 30 is electrically coupled between an electrical service connection and the sump pump 4 via the information handling system 100. The control interface program 30 is also operationally coupled to the level sensing assembly 22. The control interface program 30 activates the sump pump 4 when the level sensing assembly 22 signals that water in the sump pit 2 has reached a predetermined level.

In a preferred embodiment the level sensing assembly 22 comprises a plurality of thermistors 24 positioned in the sump pit 2. Each one of the plurality of thermistors 24 changes resistance when in contact with water. Thus, the level of water in the sump pit 2 is determinable. Other types of level sensors may be used, however contact type sensors by not function properly with debris or contaminated water, and float type systems may stick and not operate properly, especially after prolonged dry periods.

In at least one embodiment, the control assembly 30 monitors the nominal operating condition of the level sensing assembly 22. Each one of the plurality of thermistors 24 has a nominal value of resistance for a dry condition and a second nominal value for a wet condition. Both nominal values have associated maximum and minimum values making up a tolerance around the nominal value. The control assembly 30 monitors the resistance value of each one of the plurality of thermistors 24. The monitoring may be continuous, periodic, or on a as requested basis. The control assembly 30 reports any out of tolerance conditions for any one of the plurality of thermistors 24 through a user alarm.

A local sensor 60 is used for detecting a water level outside of the sump pit 2. The local sensor 60 is also operationally coupled to the control interface program 30.

A secondary level detection assembly 26 for detecting water overflowing from the sump pit 2 may also be included. The secondary level detection assembly 26 is operationally coupled to the control interface program 30. A secondary pump 28 may operationally coupled to the control interface program 30, and activated when the secondary level detection assembly 26 detects a fluid above a predetermined secondary level. The secondary level detection assembly 26 and the secondary pump 28 may be employed as a primary system for locations not having a sump pit.

A modem 32 may be operationally coupled to the control interface program 30. The modem 32 is couplable to a conventional telephone system, for dialing out on the conventional telephone system to relay an alarm condition from the control interface program 30 to a remote location.

A backup battery system 34 may be included for providing electrical power to the control interface program 30 and the modem 32 in the event of electrical failure. Thus, the alarm condition from the control interface program 30 may be relayed during power failure.

In an embodiment the modem 32 relays at least one of a plurality of predetermined voice messages associated with the alarm condition. Thus, a person listening at the remote location can determine the alarm condition.

In still a further embodiment, the computer interface 38 further includes a power line modem 40 for routing data over existing in-situ power lines thereby decreasing a need for custom wiring of the system for installation. Similarly, power line modems 40 may be used with additional sensors and pumps to facilitate installation of the system.

In still yet a further embodiment, a flood detection assembly 50 may be operationally coupled to the control interface program 30. The flood detection assembly 50 detects rising flood waters and signals the control interface program 30. Additionally, the flood detection assembly 50 also detects receding flood water and signals the control interface program 30.

In still yet a further embodiment, a flood detection assembly 50 may be operationally coupled to the control interface program 30. The flood detection assembly 50 detects rising flood waters, both in terms of absolute level and rate of rise, and signals the control interface program 30 to open circuit electrical contacts which could disconnect utility power to the area which is prone to flooding when the level rises above the lowest utility supplied electrical equipment. At this point, the battery backup, mentioned above, could supply power to continue pumping in a totally watertight electrical mode. Additionally, in the event that the monitored flood waters reach a pre-determined "hopeless" level the control interface program 30 could conserve fuel and mechanical resources by shutting down the pumping and generating activities. The Rate of rise sensing is intended to conserve generator fuel by alerting the control to shut down the pump when the water is rising at a rate calculated to be far greater than the capacity of the pump. Additionally, the flood detection assembly 50 also detects receding flood water and signals the control interface program 30 to resume all appropriate pumping and generating activities at the pre selected level and/or rate where pumping is expected to once again become practical.

A pop-up window 42 may operationally generated by the control interface program 30. The pop-up window 42 may include a a visual indication of an alarm condition and/or a system status.

A plurality of local sensors 60 may be operationally coupled to the control interface program 30. The plurality of local sensors 60 may include: a water heater leak sensor 61 for sensing a leak from a conventional water heater, a laundry leak sensor 62 for sensing a leak from a conventional washing machine, a dishwasher leak sensor 63 for sensing a leak from a conventional dishwasher, a sink leak detector 64 for sensing a leak from a conventional sink, a bathroom leak detector 65 for sensing a water leak in a bathroom, a pool sensor 66 for detecting a high water level in pool, and a septic system sensor 67 for detecting a high level in a septic system. The control interface program 30 may generate an alarm uniquely associated with each one of the sensors. Additionally, the control interface program 30 may activate a solenoid 68 to shut off a water supply when the alarm is generated.

In at least one embodiment, the control interface program 30 may also monitor the nominal operating condition of each one of the local sensors 60, the secondary level detection assembly 26, the flood detection assembly 50, and the sewage level detection assembly 56. As with monitoring the level sensing assembly 22, each one of the local sensors, 60, the secondary level detection assembly 26, the flood detection assembly 50, and the sewage level detection assembly 56 utilize a plurality of thermistors. Each one of these thermistors has a nominal value of resistance for a dry condition and a second nominal value for a wet condition. Both nominal values have associated maximum and minimum values making up a tolerance around the nominal value. The control interface program 30 monitors the resistance value of each one of the plurality of thermistors for each one of the local sensors 60, the secondary level detection assembly 26, the flood detection assembly 50, and the sewage level detection assembly 56. The monitoring may be continuous, periodic, or on a as requested basis. The control interface program 30 reports any out of tolerance conditions for any one of the plurality of thermistors through a user alarm.

In an embodiment, the system includes a manual pump actuation assembly 70, which provides a user with a means of actuating the sump pump 4 on demand. The manual pump actuation assembly 70 is operationally coupled to the control interface program 30.

In even still a further embodiment, the system includes at least one video camera 72 operationally coupled to the control interface program 30. Upon an alarm condition or when requested by a user, the system 10 can provide a video image of an area being monitored by the video camera 72. The modem 32 may relay at least one video image associated with the alarm condition. Thus, a person monitoring at the remote location can visually determine the severity of the situation associated with the alarm condition.

In still yet a further embodiment, a position of the video camera(s) 72 may be adjusted by the control interface program 30 by zooming, tilting or panning the camera 72 to change an area of monitoring when commanded by the control interface program 30. The control interface program 30 may receive instructions from a remote user via the modem 32. Thus, the positioning of the video camera(s) 72 is controllable by a remote user.

A video motion detector 73 may be operationally coupled to the video camera(s) 72 to determine an occurrence of motion based upon a video image from the video camera(s) 72. Further, the system may include a video motion filter 74 capable of selecting a sub-area of the video image for determining the occurrence of motion, and selecting a threshold of motion necessary to generate a supplemental signal indicating the occurrence of motion.

Figure 3:
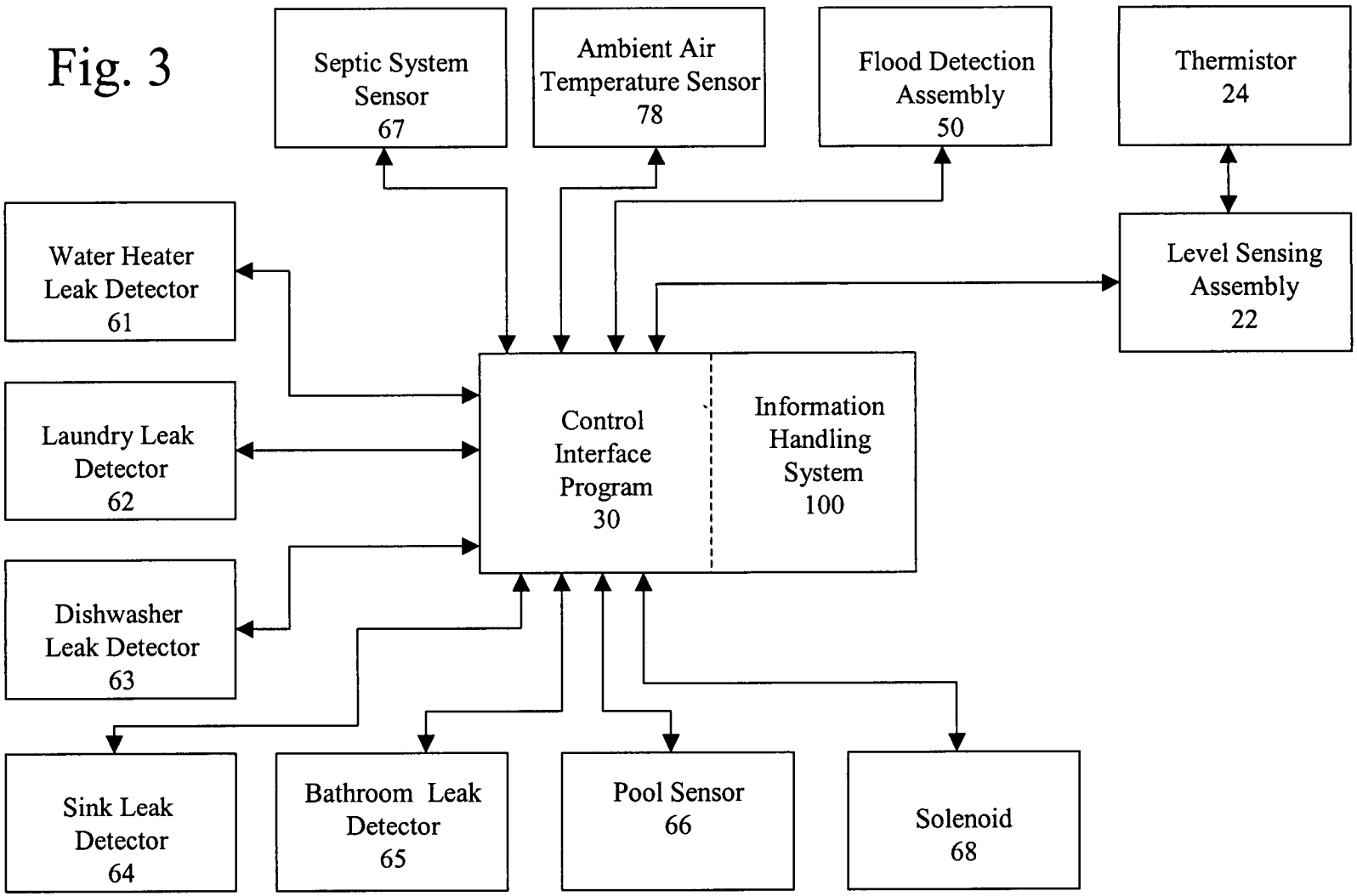
FIG. 3 is a schematic block diagram of an embodiment of the present invention using multiple local sensors.
Figure 4:
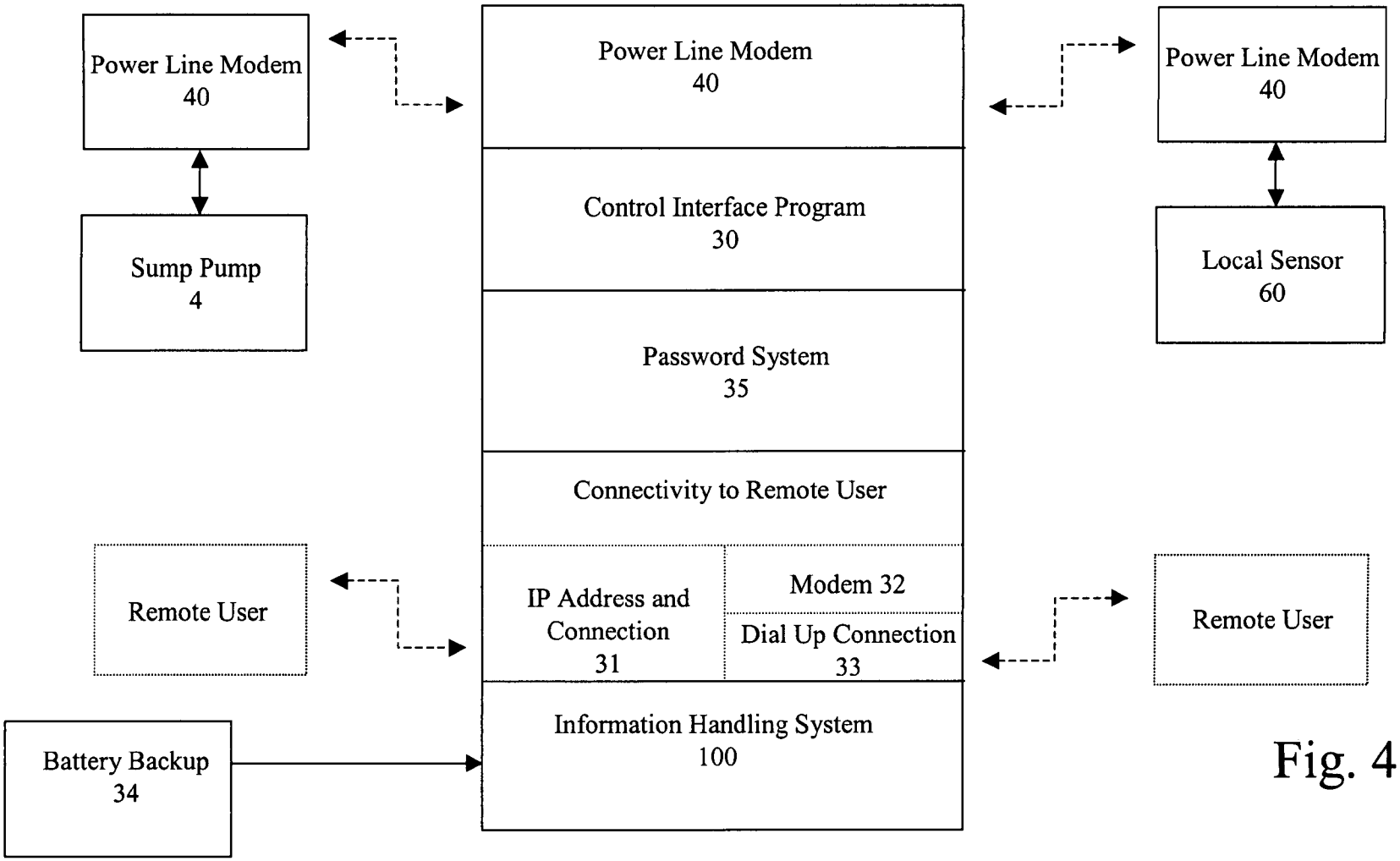
FIG. 4 is a schematic block diagram of the present invention utilizing power line modems to minimize custom in-situ wiring.
Figure 5:
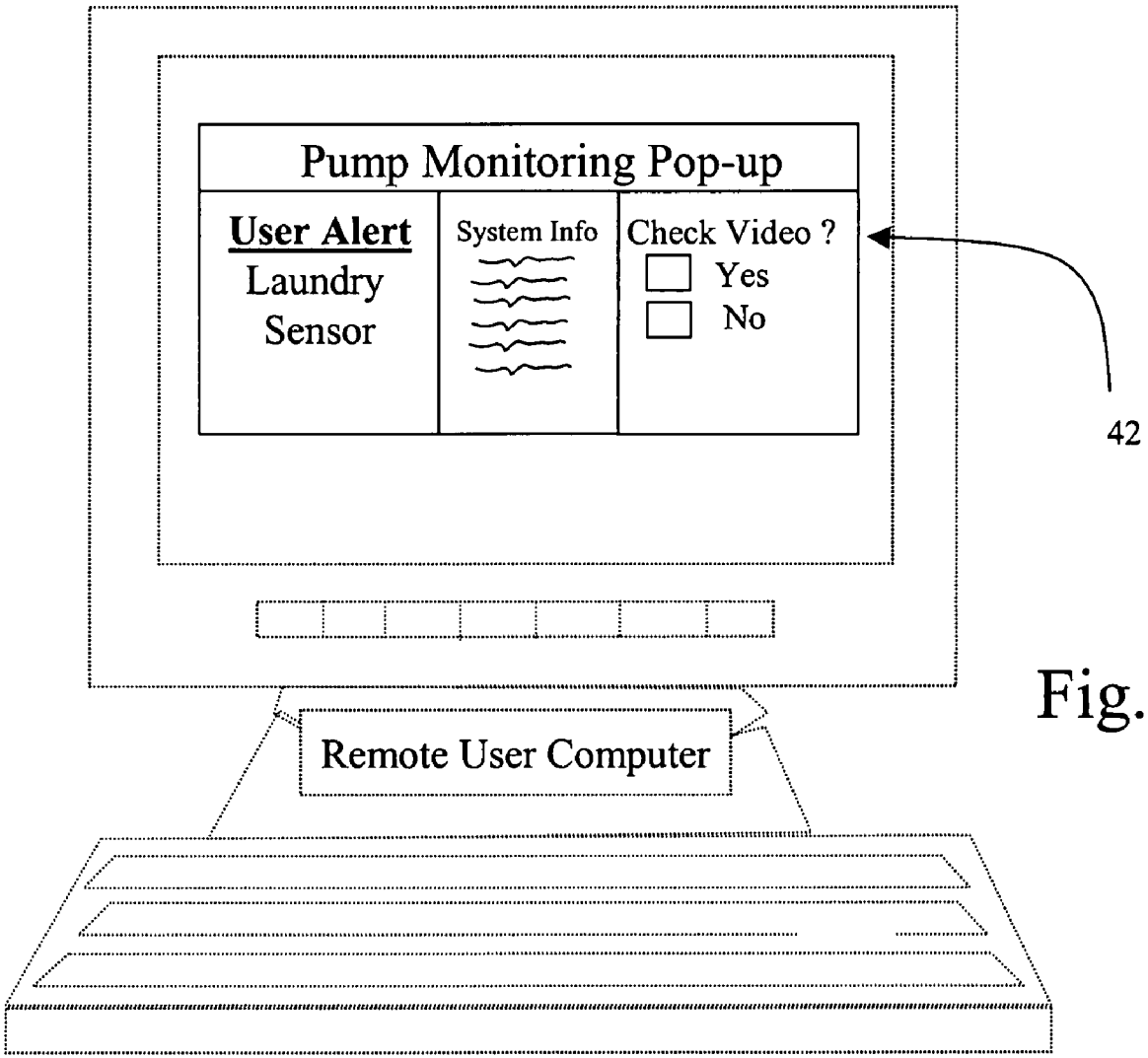
FIG. 5 is a schematic notional representation of the pop-up window generated by the present invention for a remote user.

As an illustrative example of this type of detection and filtering, FIG. 3 shows a typical laundry room being monitored by the system 10. The video motion detector 73 and the video motion filter 74 allow the system to operate without an alarm condition for normal movement of the drapes as shown. However, FIG. 4, shows that when abnormal or unexpected movement occurs, the system 10 enters an alarm condition.

Further, at least one audio transducer 76 for selectively capturing ambient audio in an area to be monitored may be operationally coupled to the control interface program 30 for providing a representation of the ambient audio to a user.

Most preferably, the control interface program 30 is remotely accessible by a remote user through a remote connection means at any time. Thus, the system 10 may be controlled by the remote user. The remote connection means may be a dial-up connection 33 operationally interacting with said modem 32, an internet protocol (IP) address 31, or other suitable connection method. A password system 35 may be used for inhibiting unauthorized access to the control interface program 30 through the remote connection means Additionally, an embodiment of the present invention may include at least one ambient air temperature sensor which is operationally coupled to the control interface program. The control interface program may generate a user alarm if the ambient air temperature either exceeds or falls below a predetermined threshold value. As an illustrative example, the control interface program may generate a user alarm if the ambient air temperature sensor indicates an air temperature at or near freezing. Thus, the ambient air temperature sensor used in conjunction with the control interface program could be used to generate a warning to a remote user that water pipes may be freezing, allowing for repair of the pipes prior to thawing and flooding of an adjacent area.

It is to be noted that the description of the above embodiments is not intended to limit the elements and construction of an embodiment to that particular embodiment. Rather, each of the individual elements of any of the embodiments may be used in any combination with any of the elements of any or all of the embodiments.

Further, although described in terms of software or a program, it will be readily appreciated by those skilled in the art that a hardware implementation of the control interface program does not depart from the scope and spirit of the disclosure. For example, hardware components such as application specific integrated circuits ("ASICs"). Implementation of the hardware state machine so as to perform the functions described herein will be apparent to persons having ordinary skill in the relevant art.

In yet another embodiment, the invention is implemented using a combination of both hardware and software. It is understood that modification or reconfiguration of the information handling system 100 by one having ordinary skill in the relevant art does not depart form the scope or the spirit of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pump control and management system interfaced with a conventional information handling system and operationally coupled to a sump pump comprising:

a level sensing assembly positioned within the sump pit for detecting a level of water in the sump pit;

a control interface program operationally interacting with the conventional information handling system, said control interface program being operationally coupled to the sump pump through the conventional information handling system, said control interface program being operationally coupled to said level sensing assembly through the conventional information handling system, said control interface program activating the sump pump when said level sensing assembly signals that water in the sump pit has reached a predetermined level; and at least one local sensor for detecting a water level outside of the sump pit, said local sensor being operationally coupled to said control interface program through the conventional information handling system.

2. The system of claim 1, wherein said level sensing assembly comprises a plurality of thermistors positioned in the sump pit, each one of said plurality of thermistors changing resistance when in contact with water whereby the level of water in the sump pit is determinable.

3. The system of claim 2, wherein said control interface program monitors a resistance value associated—with each one of said plurality of thermistors, said control interface program generating a user alarm upon any one of said plurality of thermistors having a resistance value outside of a predetermined range.

4. The system of claim 1, wherein said control interface program monitors a resistance value associated with each one of said at least one local sensor, said control interface program generating a user alarm upon any one of said at least one local sensor having a resistance value outside of a predetermined range.

5. The system of claim 1, further comprising:

a secondary level detection assembly for detecting water over flowing from the sump pit, said secondary level detection assembly being operationally coupled to said control interface program through the conventional information handling system; and a secondary pump operationally coupled to said control interface program through the conventional information handling system, said secondary pump being activated when said secondary level detection assembly detects a fluid above a predetermined secondary level.

6. The system of claim 5, wherein said control interface program monitors a resistance value associated with said secondary level detection assembly, said control interface program generating a user alarm upon said secondary level detection assembly having a resistance value outside of a predetermined range.

7. The system of claim 1, further comprising a modem operationally interacting with said control interface program, said modem being coupleable to a conventional telephone system, said modem being for dialing out on the conventional telephone system to relay an alarm condition from said control interface program to a remote location.

8. The system of claim 7, further comprising a backup battery system for providing electrical power to said control interface program through the conventional information handling system and said modem in the event of electrical failure whereby said alarm condition from said control interface program may be relayed during power failure.

9. The system of claim 7, wherein said modem relays at least one of a plurality of predetermined voice messages associated with said alarm condition whereby a person listening at the remote location can determine the alarm condition.

10. The system of claim 1, further comprises at least two power line modems for routing data over existing in-situ power lines thereby decreasing a need for custom wiring of the system for installation.

11. The system of claim 1, further comprising a flood detection assembly operationally coupled to said control interface program through the conventional information handling system, said flood detection assembly detecting rising flood waters and signaling said control interface program, said flood detection assembly detecting receding flood water and signaling said control interface program.

12. The system of claim 11, wherein said control interface program monitors a resistance value associated with said flood detection assembly, said control interface program generating a user alarm upon said flood detection assembly having a resistance value outside of a predetermined range.

13. The system of claim 1, wherein said control interface program generates a pop-up window viewable on the conventional information handling system for providing a visual indication of an alarm condition, said control interface program operationally interacting with a speaker of the conventional information handling system for providing an aural indication of an alarm condition.

14. The system of claim 1, wherein said at least one local sensor further comprises:

a water heater leak sensor operationally coupled to said control interface program through the conventional information handling system for sensing a leak from a conventional water heater;

a laundry leak sensor operationally coupled to said control interface program for sensing a leak from a conventional washing machine;

a dishwasher leak sensor operationally coupled to said control interface program through the conventional information handling system for sensing a leak from a conventional dishwasher;

a sink leak detector operationally coupled to said control interface program through the conventional information handling system for sensing a leak from a conventional sink;

a bathroom leak detector operationally coupled to said control interface program through the conventional information handling system for sensing a water leak in a bathroom;

a pool sensor operationally coupled to said control interface program through the conventional information handling system for detecting a high water level in pool;

a septic system sensor operationally coupled to said control interface program through the conventional information handling system for detecting a high level in a septic system;

said control interface program generating an alarm uniquely associated with each one of said water heater leak sensor, said laundry leak sensor, said a dishwasher leak sensor, said sink leak detector, said bathroom leak detector, said pool sensor, and said septic system sensor, said control interface program activating a solenoid through the conventional information handling system to shut off a water supply when said alarm is generated.

15. The system of claim 1 further comprising a manual pump actuation assembly for providing a user with a means of actuating the sump pump on demand, said manual pump actuation assembly being operationally coupled to said control interface program.

16. The system of claim 1, further comprising a video camera operationally coupled to said control assembly through the conventional information handling system, said video camera monitoring an area associated with at least one of said sensors, said video camera providing at least one image to be relayed through said modem to a remote location upon generation of an alarm associated with one of said sensors.

17. The system of claim 16, further comprising at least one motion sensor operationally coupled to said video camera and said control interface program through the conventional information handling system, said motion sensor generating an alarm condition when motion is detected.

18. The system of claim 17, wherein said system generates an email message to be transmitted through said modem to a remote user when an alarm condition is detected by said control interface program.

19. The system of claim 18, wherein said email message further comprises at least one image captured by said video camera concurrent with said alarm condition.

20. The system of claim 17, wherein said system generates a facsimile message through said modem for send remote facsimile machine when an alarm condition is detected by said control interface program.

21. The system of claim 16, wherein a position of said at least one video camera being adjustable by said control interface program, said video camera tilting to change an area of monitoring when commanded by said control interface program, said video camera being panning when commanded by said control interface program to change an area of monitoring.

22. The system of claim 21, wherein said control interface program commanding said at least one video camera to tilt upon receiving an instruction from a remote user via said modem and said control interface program commanding said at least one video camera to pan upon receiving an instruction from a remote user via said modem and said control interface program commanding said at least one video camera to zoom upon receiving an instruction from a remote user via said modem whereby positioning of said at least one video camera is controllable by a remote user.

23. The system of claim 1, further comprising a motion detection means for providing a supplemental signal to said control interface program, said supplemental signal being used to alert a user.

24. The system of claim 23, wherein said motion detection means further comprises:

at least one video camera being adjustable by said control interface program, said video camera tilting to change an area of monitoring when commanded by said control interface program, said video camera panning when commanded by said control interface program to change an area of monitoring, said video camera zooming when commended by said control interface program;

a video motion detector operationally coupled to said at least one video camera to determine an occurrence of motion based upon a video image from said at least one video camera.

25. The system of claim 24, wherein said motion detection means further comprises a video motion filter, said filter being capable of selecting a sub-area of said video image for determining the occurrence of motion, said filter being capable of selecting a threshold of motion necessary to generate said supplemental signal.

26. The system of claim 1, further comprising at least one audio transducer for selectively capturing ambient audio in an area to be monitored, said at least one audio transducer being operationally coupled to said control interface program for providing a representation of the ambient audio to a user.

27. The system of claim 1, wherein said control interface program being remotely accessible by a remote user whereby said system may be controlled by the remote user.

28. The system of claim 27, wherein said control interface program being remotely accessible by the remote user through a dial-up connection operationally interacting with said modem, whereby the remote user may dial a telephone number associated with said modem and interact with said control interface program.

29. The system of claim 28, further comprising a password system for inhibiting unauthorized access to said control interface program through said dial-up connection.

30. The system of claim 1, wherein said control interface program having a physical implementation whereby a hardware connection facilitates operational interaction between said control interface program and the conventional information handling system.

31. The system of claim 1, further comprising:

said level sensing assembly comprises a plurality of thermistors positioned in the sump pit, each one of said plurality of thermistors changing resistance when in contact with water whereby the level of water in the sump pit is determinable;

at least one local sensor for detecting a water level outside of the sump pit, said local sensor being operationally coupled to said control interface program through the conventional information handling system;

a secondary level detection assembly for detecting water overflowing from the sump pit, said secondary level detection assembly being operationally coupled to said control interface program through the conventional information handling system;

a secondary pump operationally coupled to said control interface program through the conventional information handling system, said secondary pump being activated when said secondary level detection assembly detects a fluid above a predetermined secondary level;

a modem operationally interacting with said control interface program, said modem being coupleable to a conventional telephone system, said modem being for dialing out on the conventional telephone system to relay an alarm condition from said control interface program to a remote location;

a flood detection assembly operationally coupled to said control interface program through the conventional information handling system, said flood detection assembly detecting rising flood waters and signaling said control interface program, said flood detection assembly detecting receding flood water and signaling said control interface program; and wherein said control interface program generates a pop-up window viewable on the conventional information handling system for providing a visual indication of an alarm condition, said control interface program operationally interacting with a speaker of the conventional information handling system for providing an n aural indication of an alarm condition.

32. The system of claim 31, further comprising:

wherein said control interface program monitors a resistance value associated with each one of said level sensing assembly, said at least one local sensor, said secondary level detection assembly, said sewage level detection assembly, and said flood detection assembly;

said control interface program providing a user alarm upon any one of said plurality of said level sensing assembly, said at least one local sensor, said secondary level detection assembly, said sewage level detection assembly, and said flood detection assembly having a resistance value outside of a predetermined range.

33. The system of claim 31, further comprising:

a backup battery system for providing electrical power to said control interface program through the conventional information handling system and said modem in the event of electrical failure whereby said alarm condition from said control interface program may be relayed during power failure;

at least two power line modems for routing data over existing in-situ power lines thereby decreasing a need for custom wiring of the system for installation;

a manual pump actuation assembly for providing a user with a means of actuating the-sump pump on demand, said manual pump actuation assembly being operationally coupled to said control interface program; and wherein said control interface program having a physical implementation whereby a hardware connection facilitates operational interaction between said control interface program and the conventional information handling system.

34. The system of claim 31, wherein said control interface program being operationally coupled to an internet whereby said control interface program is accessible through an internet protocol (IP) address, whereby the remote user may access an internet page and interact with said control interface program.

35. The system of claim 34, further comprising a password system for inhibiting unauthorized access to said control interface program through said internet protocol (IP) address.

36. The system of claim 31, further comprising:

at least one video camera operationally coupled to said control interface program, said video camera monitoring an area associated with at least one of said sensors, said video camera providing at least one image to be relayed through said modem to a remote location upon generation of an alarm associated with one of said sensors;

wherein a position of said at least one video camera being adjustable by said control interface program, said video camera tilting to change an area of monitoring when commanded by said control interface program, said video camera being panning when commanded by said control interface program to change an area of monitoring;

said control interface program commanding said at least one video camera to tilt upon receiving an instruction from a remote user via said modem and said control interface program commanding said at least one video camera to pan upon receiving an instruction from a remote user via said modem and said control interface program commanding said at least one video camera to zoom upon receiving an instruction from a remote user via said modem whereby positioning of said at least one video camera is controllable by a remote user;

a video motion detector operationally coupled to said at least one video camera to determine an occurrence of motion based upon a video image from said at least one video camera; and a video motion filter being capable of selecting a sub-area of said video image for determining the occurrence of motion, said filter being capable of selecting a threshold of motion necessary to generate a supplemental signal.

37. The system of claim 31, further comprising at least one audio transducer for selectively capturing ambient audio in an area to be monitored, said at least one audio transducer being operationally coupled to said control interface program for providing a representation of the ambient audio to a user.

38. The system of claim 31, further comprising: said control interface program being remotely accessible by the remote user through a dial-up connection operationally interacting with said modem, whereby the remote user may dial a telephone number associated with said modem and interact with said control interface program; and a password system for inhibiting unauthorized access to said control interface program through said dial-up connection.

39. The system of claim 31, further comprising:

wherein said control interface program being remotely accessible by a remote user through a remote connection means whereby said system may be controlled by the remote user;

said remote connection means being selected from the group of remote connection means consisting of a dial-up connection operationally interacting with said modem, and an internet protocol (IP) address; and a password system for inhibiting unauthorized access to said control interface program through said remote connection means.

40. The system of claim 31, further comprising:

at least one video camera operationally coupled to said control interface program, said video camera monitoring an area associated with at least one of said sensors, said video camera providing at least one image to be relayed through said modem to a remote location upon generation of an alarm associated with one of said sensors;

wherein a position of said at least one video camera being adjustable by said control interface program, said video camera tilting to change an area of monitoring when commanded by said control interface program, said video camera being panning when commanded by said control interface program to change an area of monitoring;

said control interface program commanding said at least one video camera to tilt upon receiving an instruction from a remote user via said modem and said control interface program commanding said at least one video camera to pan upon receiving an instruction from a remote user via said modem and said control interface program commanding said at least one video camera to zoom upon receiving an instruction from a remote user via said modem whereby positioning of said at least one video camera is controllable by a remote user;

a video motion detector operationally coupled to said at least one video camera to determine an occurrence of motion based upon a video image from said at least one video camera;

a video motion filter being capable of selecting a sub-area of said video image for determining the occurrence of motion, said filter being capable of selecting a threshold of motion necessary to generate a supplemental signal;

at least one audio transducer for selectively capturing ambient audio in an area to be monitored, said at least one audio transducer being operationally coupled to said control interface program for providing a representation of the ambient audio to a user;

wherein said control interface program being remotely accessible by a remote user through a remote connection means whereby said system may be controlled by the remote user;

said remote connection means being selected from the group of remote connection means consisting of a dial-up connection operationally interacting with said modem, and an internet protocol (IP) address; and a password system for inhibiting unauthorized access to said control interface program through said remote connection means.

41. The system of claim 31, further comprising an ambient air temperature sensor operationally coupled to said control interface program, said ambient air temperature sensor providing a representation of an ambient air temperature adjacent to a predetermined area.

42. The system of claim 41, wherein said control interface program providing a user alarm if said representation of ambient air, temperature falls below a threshold value.

43. The system of claim 1, further comprising an ambient air temperature sensor operationally coupled to said control interface program, said ambient air temperature sensor providing a representation of an ambient air temperature adjacent to a predetermined area, wherein said control interface program providing a user alarm if said representation of ambient air temperature indicates a near freezing condition.

* * * * *